US007722727B2

(12) United States Patent
Sandberg

(10) Patent No.: US 7,722,727 B2
(45) Date of Patent: May 25, 2010

(54) STEEL AND MOULD TOOL FOR PLASTIC MATERIALS MADE OF THE STEEL

(75) Inventor: Odd Sandberg, Uddeholm (SE)

(73) Assignee: Uddeholm Tooling Aktiebolag, Hagfors (SE)

( * ) Notice: Subject to any disclaimer, the term of this patent is extended or adjusted under 35 U.S.C. 154(b) by 498 days.

(21) Appl. No.: 10/514,940

(22) PCT Filed: May 7, 2003

(86) PCT No.: PCT/SE03/00728

§ 371 (c)(1),
(2), (4) Date: Jan. 14, 2005

(87) PCT Pub. No.: WO03/106727

PCT Pub. Date: Dec. 24, 2003

(65) Prior Publication Data

US 2005/0123434 A1 Jun. 9, 2005

(30) Foreign Application Priority Data

Jun. 13, 2002 (SE) ..... 0201800
Jan. 30, 2003 (SE) ..... 0300215

(51) Int. Cl.
*C22C 38/22* (2006.01)
*C22C 38/24* (2006.01)

(52) U.S. Cl. ..... 148/334; 148/333; 148/335

(58) Field of Classification Search ..... 148/333–335; 420/104–111

See application file for complete search history.

(56) References Cited

U.S. PATENT DOCUMENTS 4,886,640 A * 12/1989 Garner et al. ..... 420/111
6,024,916 A * 2/2000 Urita et al. ..... 420/110
6,773,662 B2 * 8/2004 Fisher et al. ..... 420/111

FOREIGN PATENT DOCUMENTS

| | | |
|---|---|---|
| JP | 55-24931 | 2/1980 |
| JP | 60-059052 | 5/1985 |
| JP | 02-093043 | 3/1990 |
| JP | 04-354852 | 9/1992 |
| JP | 4-354852 | 12/1992 |
| JP | 07-102342 | 4/1995 |
| JP | 07-060314 | 7/1995 |
| JP | 10-121195 | 5/1998 |
| JP | H10-273756 | 10/1998 |
| JP | 11-181549 | 7/1999 |
| JP | 2000-212700 | 8/2000 |
| JP | 2000-273590 | 10/2000 |
| JP | 2002-12700 | 1/2002 |
| JP | 2002-088443 | 3/2002 |

OTHER PUBLICATIONS

Fukui, Shoichi et al., English abstract of Japanese patent 357161051, Oct. 4, 1982.*

(Continued)

*Primary Examiner*—Deborah Yee
(74) *Attorney, Agent, or Firm*—Thomas, Karceski, Raring & Teague, P.C.

(57) ABSTRACT

The invention concerns a steel, particularly a steel for mould tools for plastic moulding, having the following chemical composition in weight-%:0.43-0.60 C from traces to 1.5 Si from traces to 1.5 (Si+Al) 0.1-2.0 Mn 3.0-7.0 Cr 1.5-4.0 (Mo+), however max. 1.0 W 0.30-0.70 V max. 0.1 of each of Nb, Ti and Zr max. 2.0 Co max. 2.0 Ni balance essentially only iron and unavoidable impurities. After hardening and high temperature tempering at 520-560° C., the steel has a hardness of 56-68 HRC.

68 Claims, 4 Drawing Sheets

OTHER PUBLICATIONS

Computer-generated English translation of Japanese patent 2000-212700, Kubota Kunichika et al., Feb. 8, 2000.*
Official Action dated Feb. 6, 2007, issued by Patent Office of the Russian Federation in counterpart Russian Application No. 2004134562/02/(037599), 5 pgs.
Examination Report for European Patent Application No. EP 03721267.7, dated Oct. 8, 2008.
Brazilian Search Report, dated Mar. 1, 2010, for Brazilian Patent Application No. PI0311756-1, which refers to the above-listed reference(s).

* cited by examiner

Fig. 1
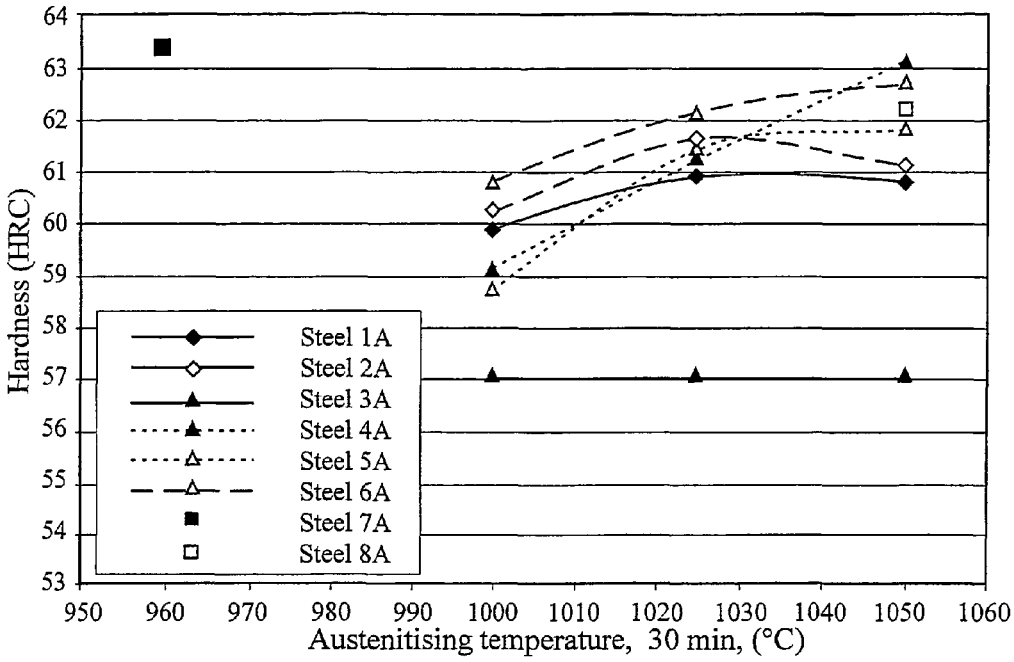
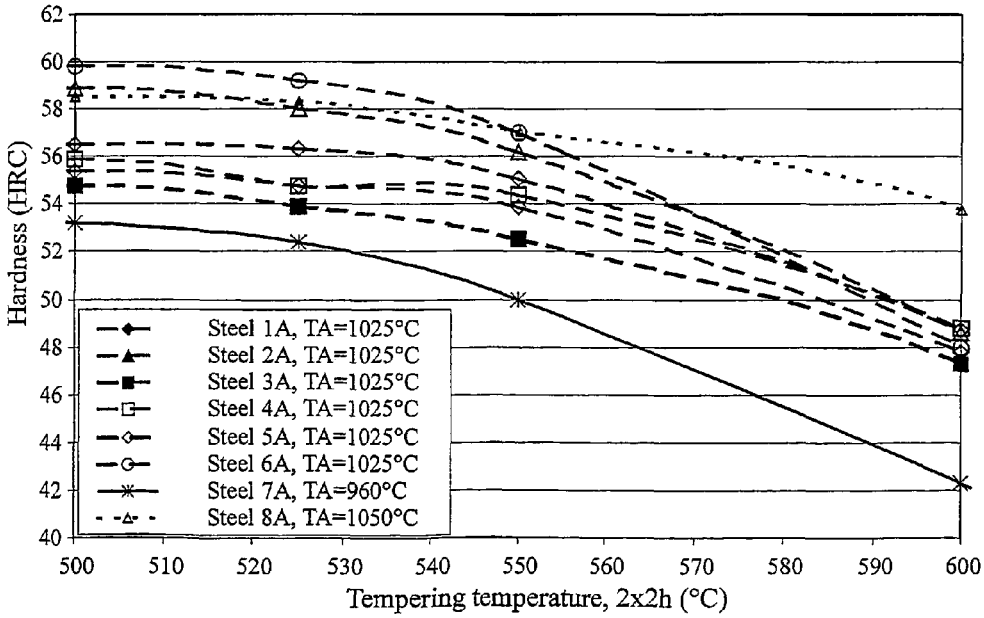
Fig. 2

STEEL AND MOULD TOOL FOR PLASTIC MATERIALS MADE OF THE STEEL

This application is the U.S. National Phase of International Application PCT/SE03/00728, filed 7 May 2003, which designated the U.S. PCT/SE03/00728 claims priority to Swedish Application Nos. 0201800-0 filed 13 Jun. 2002, and 0300215-1 filed 30 Jan. 2003. The entire content of these applications are incorporated herein by reference.

TECHNICAL FIELD

The invention relates to a steel, i.e. an alloy, intended to be used in the first place for the manufacturing of mould tools in which plastic products shall be manufactured by some kind of moulding method in the plastic or moulded condition of the plastic material. The invention also relates to tools and tool details made of the steel, and blanks of the steel alloy for the manufacturing of mould tools for plastic materials and details for such tools.

BACKGROUND OF THE INVENTION

Mould tools for plastic materials are made of a great number of various steel alloys, including martensitic, medium alloyed steels. In that group there is a commercially available steel which nominally contains 0.6% C, 4.5% Cr, 0.5% Mo and 0.2% V and which is used for cold work tools and mould tools for plastic materials. Within the same group there is also found the standardised steel AISI S7 which is also sometimes used for inter alia mould tools for moulding plastic materials, and another commercial available tool steel, which nominally contains 0.55% C, 2.6% Cr, 2.25% Mo and 0.9% V. The two first named steels attained a desired hardness only after low temperature tempering, which may cause risk for retained tensions in the steel after heat treatment. It is true that the last mentioned steel may achieve an adequate hardness after high temperature tempering, i.e. tempering at about 550° C., on the other hand the hardenability of that steel is not particularly good.

It is the purpose of the invention to provide a mould steel for moulding plastic materials which has a better combination of features for the employment of the steel for the manufacturing of mould tools for plastic materials, than the tool steels which presently are commercially available. Particularly, the steel should have the following features:

- Good ductility/toughness,
- Good hardenability allowing through hardening in connection with conventional hardening in a vacuum furnace of products with thicknesses up to at least 350 mm,
- Adequate hardness, at least 54 HRC, preferably at least 56 HRC, after hardening and high temperature tempering, which gives a high resistance against plastic deformation and, at least as far as certain applications are concerned, also an adequate wear resistance without nitriding or surface coating with titanium carbide and/or titanium nitride or the like by means of e.g. PVD- or CVD-technique,
- Good tempering resistance in order to allow nitriding or surface coating with titanium carbide and/or titanium nitride or the like by e.g. any of said techniques without reduction of the hardness of the material for applications which require particularly good wear resistance of the tool,
- Good heat treatment features,
- Good grindability, machinability by cutting operations, spark machinability, and polishability.

Other important product features are:

- Good dimension stability during heat treatment,
- Long fatigue life.

Specifically, the invention aims at providing a matrix steel which can be employed as a material for mould tools for plastic materials, i.e. a steel which is essentially void of primary carbides and which in its use condition has a matrix consisting of tempered martensite.

DISCLOSURE OF THE INVENTION

The above mentioned purposes and features can be achieved by means of a steel which is characterised by what is stated in the appending patent claims.

As far as the individual elements of the steel alloy and their mutual interaction are concerned, the following applies. Percentages mentioned in this text always refer to weight-% if not otherwise is stated.

The steel of the invention shall, as above mentioned, not contain any primary carbides but nevertheless have a wear resistance which is adequate for most applications. This is achieved by an adequate hardness within the range 54-59 HRC, suitably 56-58 HRC, in the hardened and high temperature tempered condition of the steel, at the same time as the steel shall have a very good toughness. In order to achieve this, the steel contains carbon and vanadium in well balanced amounts. Thus the steel should contain at least 0.43%, preferably at least 0.44%, and suitably at least 0.46% C. Further the steel should contain at least 0.30%, preferably at least 0.40%, and suitably at least 0.45% V in order to ensure that the martensitic matrix of the steel in the hardened and tempered condition of the steel, shall contain a sufficient amount of carbon in solid solution in order to give the matrix said hardness and also in order that an adequate amount of secondarily precipitated, very small hardness increasing vanadium carbides shall be formed in the matrix of the steel. Moreover, very small, primary precipitated vanadium carbides exist in the steel, which contribute to the prevention of grain growth during the heat treatment. Any other carbides than vanadium carbides should not exist. In order to achieve said conditions, the steel must not contain more than 0.60%, preferably max. 0.55%, and suitably max. 0.53% C, and max. 0.70%, preferably max. 0.65%, and suitably max. 0.60% V. Nominally, the steel contains 0.49% C and 0.52% V. The amount of carbon in solid solution in the hardened and high temperature tempered condition of the steel nominally amounts to about 0.45%.

Silicon exists at least in a measurable amount as a residual element from the manufacturing of the steel and is present in an amount from traces up to max. 1.5%. Silicon, however, impairs the toughness of the steel and should therefore not exist in an amount above 1.0%, preferably max. 0.5%. Normally, silicon exists in a minimum amount of at least 0.05%. An effect of silicon is that it increases the carbon activity in the steel and therefore contributes to affording the steel a desired hardness. Therefore it may be advantageous that the steel contains silicon in an amount of at least 0.1%. Nominally the steel contains 0.2% silicon.

Aluminium to some extent may have the same or similar effect as silicon at least in a steel of the present type. Both can be used as oxidation agents in connection with the manufacturing of the steel. Both are ferrite formers and may provide a dissolution hardening effect in the matrix of the steel. Silicon therefore may be partly replaced by aluminium up to an amount of max. 1.0%. Aluminium in the steel, however, makes it necessary that the steel is very well deoxidised and has a very low content of nitrogen, because aluminium oxides and aluminium nitrides otherwise would form, which would reduce the ductility/toughness of the steel considerably. Therefore, the steel should normally not contain more than max. 1.0% Al, preferably max. 0.3%. In a preferred embodiment, the steel contains max. 0.1% and most conveniently max. 0.03% Al.

Manganese, chromium and molybdenum shall exist in a steel in a sufficient amount in order to give the steel an adequate hardenability. Manganese also has the function of binding the extremely low contents of sulphur which may exist in the steel to form manganese sulphides. Manganese therefore, shall exist in an amount of 0.1-2.0%, preferably in an amount of 0.2-1.5%. Suitably, the steel contains at least 0.25% and max. 1.0% manganese. A nominal manganese content is 0.50%.

Chromium shall exist in a minimum amount of 3.0%, preferably at least 4.0% and suitably at least 4.5% in order to give the steel a desired hardenability when the steel contains manganese and chromium in amounts which are characteristic for the steel. Maximally, the steel may contain 7.0%, preferably max. 6.0% and suitably max. 5.5% chromium.

Also molybdenum shall exist in an adequate amount in the steel in order to afford, together with in the first place chromium, the steel a desired hardenability and also to give it a desired secondary hardening. Molybdenum in too high contents, however, causes precipitation of M6C carbides, which preferably should not exist in the steel. With this background, the steel therefore shall contain at least 1.5% and max. 4.0% Mo. Preferably, the steel contains at least 1.8% and max. 3.2% Mo, suitably at least 2.1% and max. 2.6% Mo in order that the steel shall not be caused to contain undesired M6C carbides at the cost of and/or in addition to the desired amount of MC carbides. Molybdenum in principal completely or partly may be replaced by tungsten for the achievement of a desired hardenability, but this requires twice as much tungsten as molybdenum which is a drawback. Also recirculation of scrap which is produced in connection with the manufacturing of the steel is made more difficult if the steel contains substantial contents of tungsten. Therefore, tungsten should not exist in an amount of more than max. 1.0%, preferably max. 0.3%, suitably max. 0.1%. Most conveniently, the steel should not contain any intentionally added amount of tungsten, which in the most preferred embodiment of the steel should not be tolerated more than as an impurity in the form of a residual element emanating from used raw materials for the manufacturing of the steel.

In addition to the said elements, the steel normally need not contain any further, intentionally added alloy elements. Cobalt, for example, is an element which normally is not required for the achievement of the desired features of the steel. However, cobalt may optionally be present in an amount of max. 2.0%, preferably max. 0.7%, in order to further improve the tempering resistance. Normally, however, the steel does not contain any cobalt exceeding impurity level. Another element which normally need not exist in the steel, but which optionally may be present, is nickel, in order to improve the ductility of the steel. At too high contents of nickel, however, there is a risk of formation of retained austenite. Therefore the nickel content must not exceed max. 2.0%, preferably max. 1.0%, suitably max. 0.7%. If an effective content of nickel is considered to be desired in the steel, the content e.g. may amount to 0.30-0.70%, suitably to about 0.5%. In a preferred embodiment, when it is considered that the steel has a sufficient ductility/toughness also without nickel, the steel, in relation to cost reasons, should not contain nickel in amounts exceeding that content of nickel which the steel unavoidably will contain in the form of an impurity from used raw materials, i.e. less than 0.30%. Further, the steel in a manner per se, can optionally be alloyed with very small contents of different elements in order to improve the features of the steel in various respects, e.g. its hardenability, or for facilitating the manufacturing of the steel. For example, the steel may optionally be alloyed with boron in contents up to about 30 ppm in order to improve the hot ductility of the steel.

Other elements, on the other hand, are explicitly undesired. Thus, the steel does not contain any other strong carbide formers than vanadium. Niobium, titanium, and zirconium, for example, are explicitly undesired. Their carbides are more stabile than vanadium carbide and require higher temperature than vanadium carbide in order to be dissolved at the hardening operation. While vanadium carbides begin to be dissolved at 1000° C. and are in effect completely dissolved at 1100° C., niobium carbides do not start to be dissolved until at about 1050° C. Titanium carbides and zirconium carbides are even more stabile and do not start to be dissolved until temperatures above 1200° C. are reached and are not completely dissolved until in the molten condition of the steel. Strong carbide and nitride formers other than vanadium, particularly titanium, zirconium, and niobium, therefore must not exist in amounts above 0.1%, preferably max. 0.03%, suitably max. 0.010%. Most conveniently, the steel does not contain more than max. 0.005% of each of said elements. Also the contents of phosphorus, sulphur, nitrogen and oxygen are kept at a very low level in the steel in order to maximise the ductility and toughness of the steel. Thus, phosphorus may exist as an unavoidable impurity in a maximum amount of 0.035%, preferably max. 0.015%, suitably max. 0.010%. Oxygen may exist in a maximal amount of 0.0020% (20 ppm), preferably max. 0.0015% (15 ppm), suitably max. 0.0010% (10 ppm). Nitrogen may exist in an amount of max. 0.030%, preferably max. 0.015%, suitably max. 0.010%.

If the steel is not sulphurised in order to improve the machinability of the steel, the steel contains max. 0.03% sulphur, preferably max. 0.010% S, suitably max. 0.003% (30 ppm) sulphur. However, one may conceive to improve the machinability of the steel by intentional addition of sulphur in an amount above 0.03%, preferably above 0.10% up to max. 0.30% sulphur. If the steel is sulphurised, it may in a manner known per se also contain 5-75 ppm Ca and 50-100 ppm oxygen, preferably 5-50 ppm Ca and 60-90 ppm oxygen.

During the manufacturing of the steel, there are produced ingots or blanks having a mass exceeding 100 kg, preferably up to 10 tons and thicknesses exceeding about 200 mm, preferably up to at least 350 mm. Preferably, conventional melt metallurgical manufacturing is employed via ingot casting, suitably bottom casting. Also continuous casting may be employed, provided it is followed by recasting to desired dimensions according to above, e.g. by ESR remelting. Powder metallurgy manufacturing or spray forming are unnecessarily expensive processes and do not give any advantages which motivate the cost. The produced ingots are hot worked to desired dimensions, when also the cast structure is broken down.

The structure of the hot worked material can be normalised in different ways by heat treatment in order to optimise the homogeneity of the material, e.g. by homogenisation treatment at high temperature, suitably at 1200-1300° C. The steel is normally delivered by the steel manufacturer to the customer in the soft annealed condition of the steel; hardness about 160-220 HB, normally about 190 HB. The tools are normally manufactured by machining operations in the soft annealed condition of the steel, but it is also conceivable per se to manufacture the tools by conventional machining operations or by spark machining in the hardened and tempered condition of the steel.

The heat treatment of the manufactured tools is normally carried out by the customer, preferably in a vacuum furnace, by hardening from a temperature between 950-1075° C., suitably at 1000-1050° C., for complete dissolution of existing carbides, for a period of time between 15 min to 2 h, preferably for 15-60 min, followed by cooling to 20-70° C., and high temperature tempering at 500-570° C., suitably at 520-560° C. In the soft annealed condition of the steel, the steel has a ferritic matrix containing evenly distributed, small carbides, which may be of different kind. In the hardened and not tempered condition, the steel has a matrix consisting of untempered martensite. In terms of calculation by known theoretical calculations, the steel at equilibrium contains about 0.6 vol-% MC carbides. At high temperature tempering, an additional precipitation of MC carbides is obtained, which affords the steel its intended hardness. These carbides have a sub microscopic size. The amount of carbides is therefore impossible to state by conventional microscopic studies. If the temperature is increased too much, the MC carbides are caused to be more coarse and become instable, which instead causes rapidly growing chromium carbides to be established, which is not desired. For these reasons, it is important that the tempering is performed at the above mentioned temperatures and holding times as far as the alloy composition of the steel of the invention is concerned.

Further features and aspects of the invention will be apparent from the patent claims and from the following description of performed experiments and from the subsequent discussion.

BRIEF DESCRIPTION OF DRAWINGS

In the following description of performed experiments, reference will be made to the accompanying drawings, in which FIG. 1 is a chart illustrating the hardness after hardening of examined steels versus the austenitising temperature, FIG. 2 is a chart showing the hardness versus the tempering temperature within a limited temperature range.

DESCRIPTION OF PERFORMED EXPERIMENTS

Materials

Figure 3:
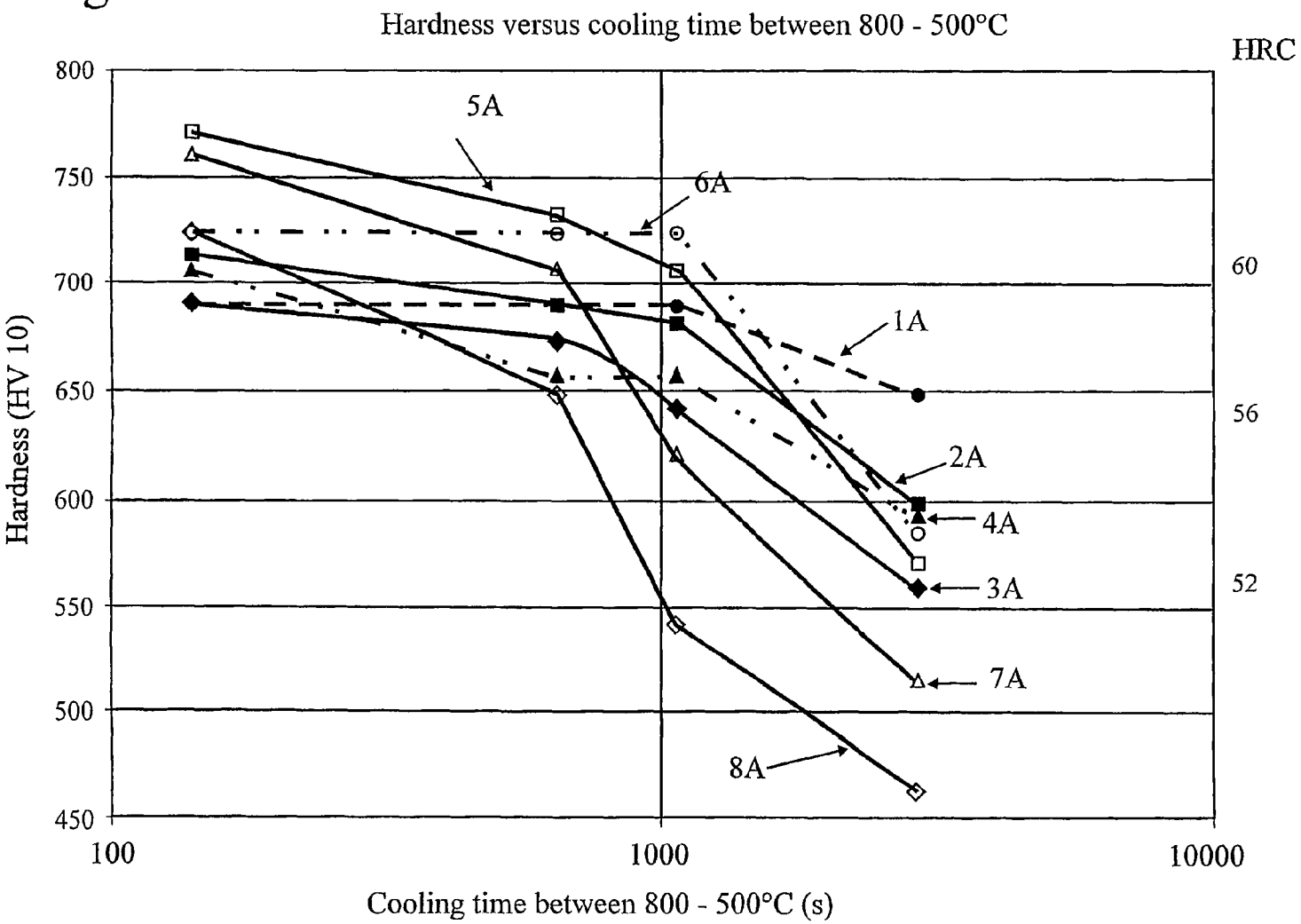
FIG. 3 is a chart illustrating the hardenability of examined steels.

Eight steel alloys were manufactured in the form of laboratory ingots having a mass of 50 kg. The chemical compositions of these ingots, which were manufactured at a laboratory scale, are given in Table 1, the steels 1A-8A. The steels 1A-6A are experimental steels, while the steels 7A and 8A are reference materials. In table 1 there are also given the aimed compositions, 1R-6R, of the experimental steels and the nominal compositions, the steels 7N and 8N, of the reference materials, and also one of the commercial steels mentioned in the preamble, steel 9N. The sulphur content of the 50 kg ingots could not be kept at a desirably low level in the majority of the laboratory heats because of the limitations of the manufacturing technique. In all the experimental steels, the content of titanium was in the order of 30 ppm and the content of niobium in the order of 10 ppm. The content of zirconium was less than 10 ppm. The following processing was applied: homogenisation treatment 10 h at 1270° C./air, forging to Ø60×60 mm, regeneration treatment at 1050° C./2 h/air, and soft annealing at 850° C./2 h, cooling 10° C./h to 600° C., then free cooling in air.

TABLE 1

Chemical composition, weight-%, of experimental alloys and reference materials, balance Fe and unavoidable impurities

| Steel | C % | Si % | Mn % | P % | S % | Cr % | Mo % | V % | N % | O (ppm) |
|---|---|---|---|---|---|---|---|---|---|---|
| 1R | 0.42 | 0.20 | 0.50 | <0.01 | ≦0.005 | 5.00 | 2.30 | 0.35 | — | — |
| 1A | 0.41 | 0.22 | 0.47 | 0.004 | 0.006 | 4.97 | 2.33 | 0.36 | 0.016 | 71 |
| 2R | 0.44 | 1.00 | 0.50 | <0.01 | ≦0.005 | 5.00 | 2.30 | 0.35 | — | — |
| 2A | 0.43 | 0.88 | 0.46 | 0.004 | 0.006 | 4.97 | 2.29 | 0.37 | 0.013 | 71 |
| 3R | 0.43 | 0.20 | 0.50 | <0.01 | ≦0.005 | 5.00 | 2.30 | 0.55 | — | — |
| 3A | 0.41 | 0.19 | 0.40 | 0.003 | 0.006 | 4.89 | 2.34 | 0.51 | 0.020 | 75 |
| 4R | 0.44 | 0.20 | 0.50 | <0.01 | ≦0.005 | 5.00 | 2.30 | 0.52 | — | — |
| 4A | 0.43 | 0.11 | 0.44 | 0.004 | 0.004 | 4.80 | 2.32 | 0.48 | 0.02 | 93 |
| 5R | 0.48 | 0.20 | 0.50 | <0.01 | ≦0.005 | 5.00 | 2.30 | 0.52 | — | — |
| 5A | 0.46 | 0.11 | 0.45 | 0.004 | 0.005 | 4.90 | 2.31 | 0.49 | 0.02 | — |
| 6R | 0.48 | 1.00 | 0.50 | <0.01 | ≦0.005 | 5.00 | 2.30 | 0.55 | — | — |
| 6A | 0.47 | 0.98 | 0.47 | 0.004 | 0.006 | 5.13 | 2.32 | 0.55 | 0.017 | 64 |
| 7N | 0.60 | 0.35 | 0.80 | <0.02 | ≦0.005 | 4.50 | 0.50 | 0.20 | | |
| 7A | 0.59 | 0.32 | 0.72 | 0.004 | 0.006 | 4.44 | 0.54 | 0.28 | 0.013 | 59 |
| 8N | 0.55 | 1.00 | 0.75 | <0.02 | ≦0.005 | 2.60 | 2.25 | 0.88 | | |
| 8A | 0.52 | 1.01 | 0.71 | 0.004 | 0.006 | 2.68 | 2.25 | 0.87 | | |
| 9N | 0.53 | 0.30 | 0.70 | <0.02 | ≦0.005 | 3.25 | 1.50 | 0.35 | | |

R: Aimed composition of experimental alloys

N: Nominal composition of reference materials

A: Analysed compositions of produced 50 kg heats

The above materials were examined with reference to hardness after soft annealing, micro-structure after different heat treatments, hardness after hardening from different austenitising temperatures, hardness after tempering at different tempering temperatures, hardenability, impact toughness, and wear resistance. These investigations are reported in the following. Moreover, theoretical equilibrium calculations were carried out by the Thermo-Calc method with reference to the content of dissolved carbon and carbide fraction at the indicated austenitising temperature for the steels which have the aimed compositions 1R-6R and the nominal compositions 7N-9N of the reference steels, respectively, Table 2.

TABLE 2

| Contents of dissolved carbon in weight- %, at the austenitising temperature, $T_A$, and volume- % MC at $T_A$ | | | | |
|---|---|---|---|---|
| Steel | Optimal $T_A$ (° C.) | % C at $T_A$ | % MC at $T_A$ | % M7C3 at $T_A$ |
| 1R | 1020 | 0.41 | 0.14 | — |
| 2R | 1020 | 0.41 | 0.42 | — |
| 3R | 1020 | 0.38 | 0.56 | — |
| 4R | 1020 | 0.39 | 0.52 | — |
| 5R | 1020 | 0.42 | 0.59 | — |
| 6R | 1020 | 0.40 | 0.93 | — |
| 7N | 960 | 0.52 | 0.13 | 1.23 |
| 8N | 1050 | 0.39 | 1.67 | — |
| 9N | 960 | 0.47 | 0.64 | — |

Soft Annealed Hardness

The soft annealed hardness, Brinell hardness (HB), of the alloys 1A-8A is given in Table 3. Table 1 and 3 show that a low silicon content reduces the soft annealed hardness.

TABLE 3

| Soft annealed hardness | |
|---|---|
| Steel | Hardness (HB) |
| 1A | 174 |
| 2A | 199 |
| 3A | 176 |
| 4A | 171 |
| 5A | 181 |
| 6A | 212 |
| 7A | 191 |
| 8A | 222 |

Micro-structure

The micro-structure was examined in the soft annealed condition and after heat treatment to hardnesses between 55 and 58 HRC of the alloys 1R-8R. The micro-structure consisted of tempered martensite in the hardened and tempered condition of the steels. No primary carbides were present. Nor could any titanium carbides, nitrides and/or carbonitrides be detected in any alloy.

Hardening and Tempering

The steels 1A-6A were austenitised by heating for 30 minutes at different temperatures between 1000 and 1050° C., while the reference steels 7A and 8A were austenitised for 30 minutes at 960° C. and 1050° C., respectively, which are the optimal austenitising temperatures of these known steels. The influence of the austenitising temperature upon the hardness of the steels 1A-6A is shown in FIG. 1, where also the hardness of the reference materials 7A and 8A after said austenitising treatment is shown.

The influence of the tempering temperature on the hardness of the steels 1A-8A after austenitising at 1025° C. of the steels 1A-6A, at 960° C. of the steel 7A, and at 1050° C. of the steel 8A, 30 min, was examined. A typical secondary hardening was observed at a temperature between 450° C. and 600° C. for all the steels except for steel 7A. FIG. 2 shows the hardness versus the tempering temperature within the interesting temperature range between 500° C. and 600° C. All the steels were tempered 2×2 h at the indicated temperatures. Steel 6A exhibited the best tempering resistance of the examined materials up to a tempering temperature of 550° C. Steel 2A had a tempering resistance which was equally as good as that of the reference material 8A up to 525° C., while the steels 1A and 3A-5A had a wear resistance on a level lower than the tempering resistance of steel 8A but significantly higher than the tempering resistance of steel 7A. The tempering resistance of the experimental alloys 1A-6A therefore may be considered to be good, which is important for a matrix steel which may require surface coating at a temperature up to about 500° C. in order to obtain a wear resistance necessary for some tool applications. In other words, at a temperature between 450° C. and 600° C., more exactly at a temperature between 500° C. and 560° C., a pronounced secondary hardening is obtained by precipitation of MC carbides. The wear resistance is favoured by a high silicon content, but also if the silicon content is low, such as in steel 5A, a hardness above 56 HRC can be maintained after high temperature tempering up to about 540° C. This is advantageous, because it makes it possible to perform the surface treatment within a rather wide temperature range without causing the hardness of the tool to be too low.

Hardenability

A comparison of the hardenability in terms of Vicker hardness (HV10) versus the time required for cooling from 800-500° C., using plotted data from CCT diagrams, is shown in FIG. 3 for the examined alloys 1A-8A. As is apparent from the chart, all experimental alloys 1A-6A have a better hardenability than the reference steels 7A and 8A. Especially steel 5A has a very good hardenability, while the reference material 8A achieves only 52 HRC in the hardened condition at $t_{8-5}$=1000 s. The reference steel 7A reaches 55 HRC, while all experimental alloys 1A-6A reach a hardness>56 HRC at said cooling rate.

Ductility

Figure 4:
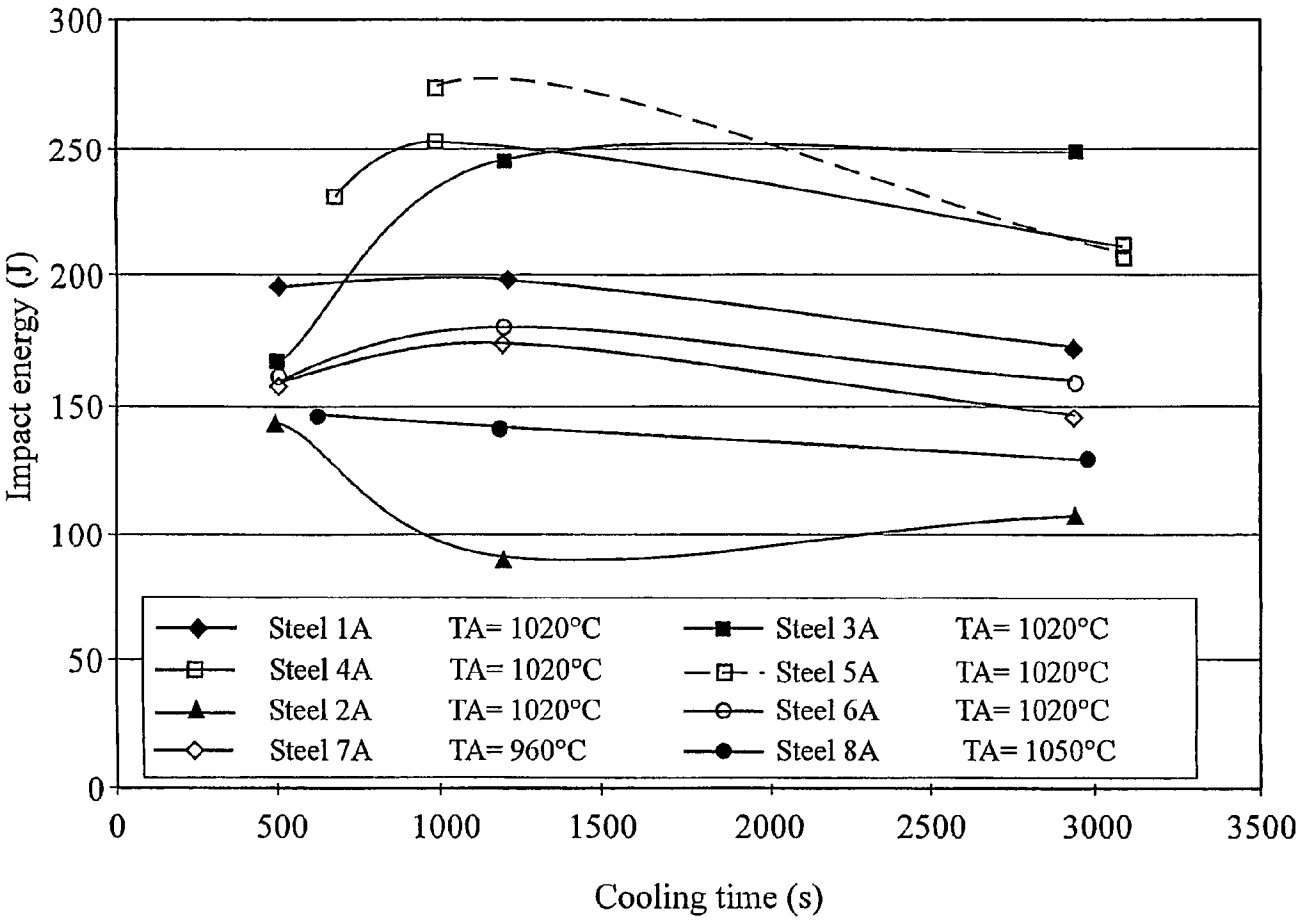
FIG. 4 shows a diagram showing the ductility in terms of impact energy versus cooling time for samples hardened in vacuum furnace followed by tempering to about 55 HRC, and, FIG. 5 and FIG. 6 are micro-photographs which at a large magnification show fracture surfaces of two examined steels.
Figure 5:
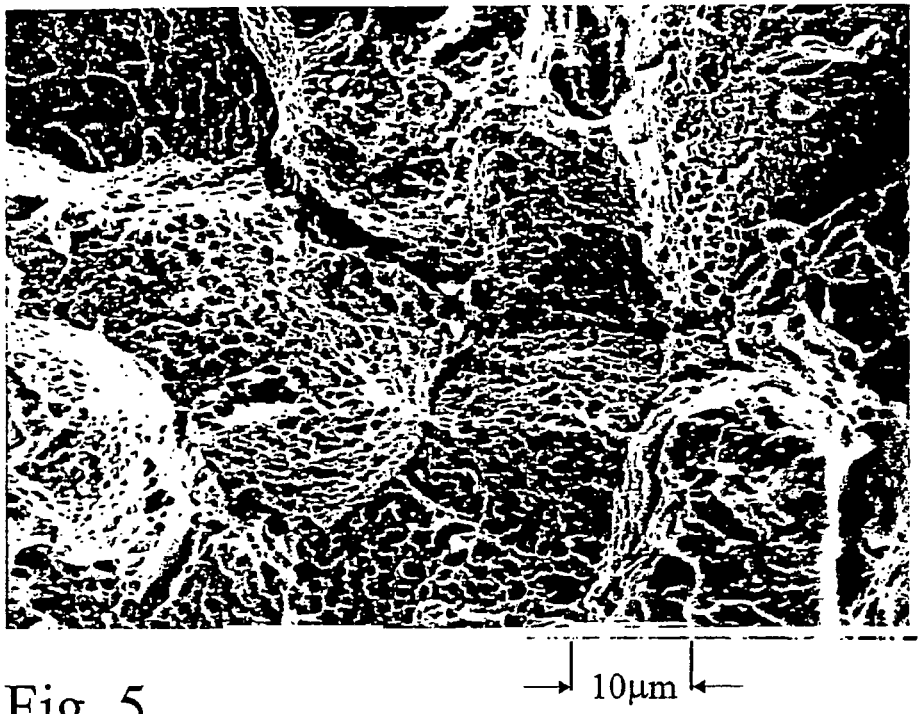
Figure 6:
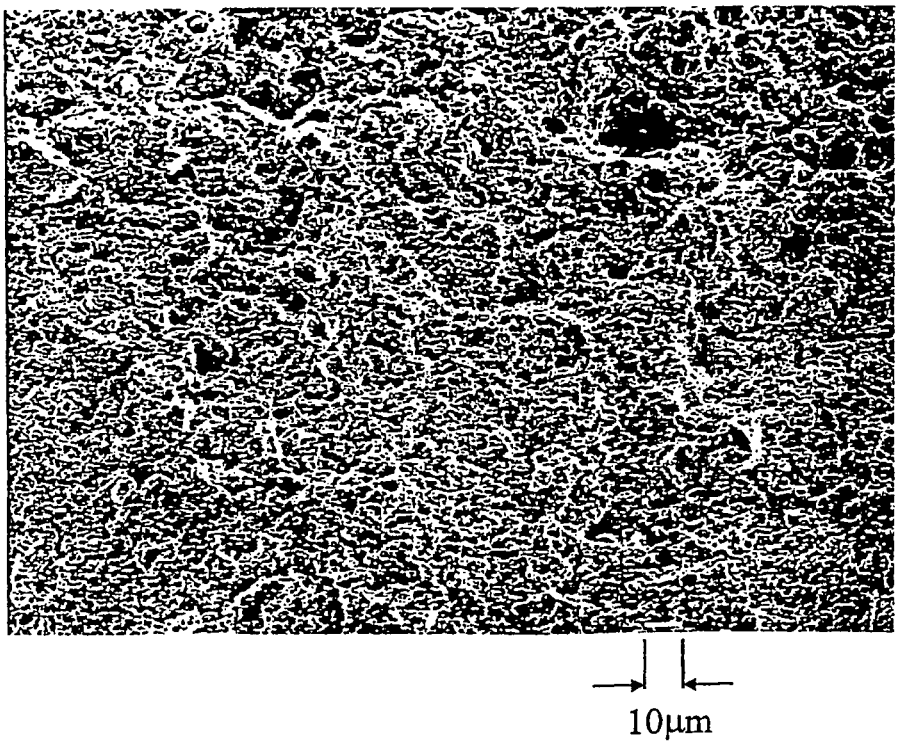

The ductility in terms of absorbed impact energy for un-notched test rods at 20° C. is shown in FIG. 4 for rods of the alloys 1A-8A cooled in a vacuum furnace versus the cooling time from 800° C. to 500° C. The shown cooling times are realistic cooling times for full size mould tools for plastic moulding. All steels are tempered to an aimed value of 55 HRC. The best ductility was obtained by the experimental alloys 3A, 4A, and 5A, which contain about 0.1% to about 0.2% Si and about 0.5% V. This is also shown in Table 4, which shows the ductility in terms of absorbed impact energy for un-notched test rods at 20° C. hardened in a vacuum furnace and cooled at a rate corresponding to $t_{8-5}$=1190 s and tempered to a hardness of 55±0.8 HRC. Corresponding variants having a lower content of vanadium have a lower ductility. Comparative studies of fracture surfaces show that the variants with the lower vanadium content have larger austenite grain sizes, FIG. 5, which can be explained by the fact that these alloys contain a lower content of austenite grain growth preventing vanadium carbides in the matrix than those variants which have a slightly higher content of vanadium. FIGS. 5 and 6 show fracture surfaces of test rods made of the alloys 1A and 3A, respectively. The microphotograph in FIG. 6 shows a ductile fracture of a test rod made of a steel with an adequate alloy composition according to the invention, which has a fine austenite grain size, which is a prerequisite for a good ductility.

TABLE 4

| Ductility in terms of absorbed impact energy in the transversal direction for un-notched test rods at 20° C.; hardness 55 ± 0.8 HRC | |
|---|---|
| Steel | Ductility (J) |
| 1A | 195 |
| 2A | 80 |
| 3A | 245 |
| 4A | 255 |
| 5A | 275 |
| 6A | 180 |
| 7A | 175 |

Wear Resistance

A pin against pin test with $SiO_2$ as an abrasive wear agent was carried out for the examined alloys 1A-8A. Steel 7A had the lowest wear resistance. At comparable hardnesses, the other steels had an equally good wear resistance. Those alloys which had a higher silicon content, however, had a somewhat better wear resistance.

Discussion

The intention of the work carried out in connection with the development of the present invention is to achieve a steel having a desired combination of features as indicated in the left column in Table 5. In the table the marks 1-3 are used, where 1=lowest and 3=best. The experimental alloy which comes nearest the ideal is steel 5A. This steel has been compared with the reference material 8A. No serious drawbacks, but many advantages, in the view of its use for mould tools for plastic moulding could be registered for the steel 5A in this comparison. In comparison with the reference material 7A, it is an important advantage that the steel can be high temperature tempered, while steel 7A requires low temperature tempering with the known drawbacks which this gives in connection with spark machining, retained high tensions after heat treatment, and restrictions as far as the choice of surface treatment is concerned. The marks for fatigue life are calculated with reference to the cleanliness of the steels. The pressure strength is calculated on the basis of the tempering temperature and the hardness of the materials after tempering. Grindability, machinability, and polishability have been calculated on the basis of the ductility, the soft annealed hardness, and the carbide content of the materials. The weldability is related to the carbon content and to the content of alloy elements. The production economy has been considered with reference to the possibility to manufacture the steels in a conventional way without problems.

TABLE 5

| Desired combination of features; comparison of features of examined steels | | | | |
|---|---|---|---|---|
| Parameters/ Features | Desired combination of features | Steel 8A | Steel 7A | Steel 5A |
| Hardenability | 3 | 1 | 2 | 3 |
| Dimension stability at heat treatment | 3 | 1 | 2 | 3 |
| Hardness after tempering (56-58 HRC) | 3 | 3 | 3 | 3 |
| Impact toughness | 3 | 2 | 1 | 3 |

TABLE 5-continued

| Desired combination of features; comparison of features of examined steels | | | | |
|---|---|---|---|---|
| Parameters/ Features | Desired combination of features | Steel 8A | Steel 7A | Steel 5A |
| Wear resistance | 2 | 2 | 3 | 3 |
| Fatigue life | 3 | 3 | 3 | 3 |
| Pressure strength | 3 | 3 | 3 | 3 |
| Grindability | 3 | 3 | 3 | 3 |
| Machinability | 3 | 3 | 3 | 2 |
| Spark machinability | 3 | 3 | 2 | 3 |
| Weldability | 2 | 2 | 1 | 2 |
| Polishability | 3 | 3 | 3 | 3 |
| Production economy | 3 | 3 | 2 | 3 |

In comparison with the ideal combination of features, steel 5A has a somewhat low hardness after hardening and high temperature tempering. On the basis of the experiences obtained by the experiments, it is estimated that the silicon content of an optimal steel composition should be about 0.2% and that the content of dissolved carbon at 1020° C. in such a steel should be about 0.45%. The silicon content, however, should not exceed 0.25% in the optimal composition in order to provide an optimal ductility/toughness of the alloy. The aimed value of the carbon content of the steel, in that case should be 0.49% in order to give an aimed hardness of 57-58 HRC after hardening and high temperature tempering. A suitable vanadium content of the optimal composition is estimated to be 0.52% in order to give a wider margin against grain growth in connection with the heat treatment. The contents of phosphorus, sulphur, nitrogen, and oxygen are kept at a very low level in order to maximise ductility and toughness. The steel shall not contain any other, intentionally added carbide formers than vanadium. Other carbide formers, such as titanium, zirconium, and niobium are each limited to max. 0.005% in the optimal alloy. Aluminium may be present as a residual from the manufacturing of the steel and is limited to max. 0.030, preferably to max. 0.015%.

An optimal alloy for mould steels for plastic moulding therefore should have the composition which is given in Table 6.

Production Scale Experiments

A steel 10P according to the invention was manufactured in an electric arc furnace. The aimed composition was the composition according to Table 6. The heat had a weight of 65 tons. The analysed composition only diverged very little from the aimed composition. The only elements which were outside of the given norm were sulphur and nitrogen, the contents of which amounted to 0.011% and 0.013%, respectively, instead of max. 0.010%. The complete composition of the steel 10P is given in Table 7, in which also the content of the most important impurities are stated. In the same table, also the composition of three examined reference materials, 7P, 8P, and 9P, taken from the applicant's production, are stated. These steels correspond to the steels 7N, 8N, and 9N, which have the nominal compositions stated in Table 1. Also the reference materials were manufactured as 65 ton heats in an electric arc furnace. All the heats were bottom casted to the shape of ingots. The ingots which were manufactured of steel 9P were also refined by ESR remelting. The ingots, including the ESR ingots, were forged to the shape of bars having different dimensions. The bars were subjected to different heat treatments before test samples were taken out. The dimensions and heat treatments of the examined bars are given in Table 8.

Then three more production heats with chemical compositions according to the invention, each of 65 tons, were manufactured in the electric arc furnace. From the steels, there were produced electrodes, which were subjected to ESR (Electro Slag Refining). The ESR ingots were forged to the shape of bars with different dimensions. These bars were also subjected to different heat treatments before test samples were taken out. Also the chemical compositions of these bars, the steels 11P, 12P, and 13P, are given in Table 7 and their dimensions and heat treatments in Table 8.

TABLE 8

Bar dimensions and heat treatments

| Steel No | Bar dimension, mm | Heat treatment |
|---|---|---|
| 7P | Ø315 | $T_A$ 960° C., 30 min<br>Tempering 200° C., 2 × 2 h |
| 8P | Broad flat bar,<br>Thickness 102 mm | $T_A$ 950° C., 30 min<br>Tempering 200° C., 2 × 2 h |
| 9P | Ø330 mm | $T_A$ 1050° C., 30 min<br>Tempering 575° C., 2 × 2 h |
| 9P | Flat bar,<br>350 × 127 mm | $T_A$ 1050° C., 30 min<br>Tempering 575° C., 2 × 2 h |
| 10P | Ø350 mm | $T_A$ 1025° C., 30 min<br>Tempering 525° C., 2 × 2 h |
| 10P | Flat bar,<br>396 × 136 mm | $T_A$ 1025° C., 30 min<br>Tempering 525° C., 2 × 2 h |
| 11P | Flat bar<br>396 × 136 mm | $T_A$ 1020° C., 30 min<br>Tempering 525° C., 2 × 2 h |
| 12P | Ø350 mm | $T_A$ 1000° C., 30 min<br>Tempering 550° C., 2 × 2 h |
| 13P | Flat bar<br>596 × 346 mm | $T_A$ 1000° C., 30 min<br>Tempering 550° C., 2 × 2 h |

The samples which were taken out from the bars according to Table 8 were examined with reference to hardness and impact toughness. The results are stated in Table 9. In this table also the kind of test rod (all the test rods were unnotched) and the position of the test rod in the bar are stated.

CL2 means test rod from a round bar, taken in the centre of the bar in the longitudal direction of the bar and with the impact direction in the square direction of the bar, CR2 means the same as CL2 but with the impact direction in the longitudal direction of the bar (most unfavourable conditions), TL2 means test rod from a flat bar and in other respects according to CR2, LT2 means test rod from a flat bar and in other respects according to CL2, and ST2 means test rod from a flat bar, taken out from the centre of the bar, in the shortest square direction and with the impact direction in the longitudal direction (most unfavourable conditions).

TABLE 9

Hardness and impact toughness of examined steels manufactured at a production scale

| Steel No, type of test rod and position | Hardness, HRC | Impact toughness, J |
|---|---|---|
| 7P, CL2 | 58 | 42 |
| 8P, TL2 | 57 | 83 |
| 9P, CL2 | 58 | 60 |
| 9P, TL2 | 58 | 159 |
| 10P, CR2 | 57.5 | 58 |
| 10P, TL2 | 57.5 | 196 |
| 11P, LT2 | 55.9 | 336 |
| 11P, ST2 | 55.9 | 216 |
| 12P, CR2 | 57 | 285 |
| 13P, ST2 | 57.7 | 239 |

TABLE 6

Optimal alloy composition, weight-%, content of dissolved carbon and carbide content at 1020° C.

| | C | Si | Mn | P | S | Cr | Mo | V | Al | N | O | C | MC Vol-% |
|---|---|---|---|---|---|---|---|---|---|---|---|---|---|
| Min. | 0.46 | 0.10 | 0.40 | — | — | 4.85 | 2.20 | 0.47 | — | — | — | 0.42 | 0.51 |
| Aimed value | 0.49 | 0.20 | 0.50 | ≦0.010 | ≦0.0010 | 5.00 | 2.30 | 0.52 | ≦0.015 | ≦0.010 | ≦0.0008 | 0.44 | 0.56 |
| Max. | 0.51 | 0.25 | 0.60 | ≦0.010 | ≦0.010 | 5.15 | 2.40 | 0.57 | ≦0.030 | ≦0.010 | ≦0.0008 | 0.46 | 0.59 |

TABLE 7

Chemical composition, weight-%, and weight-ppm, respectively, of examined production scale steels, balance Fe and impurities

| Steel No | C % | Si % | Mn % | P ppm | S ppm | Cr % | Ni % | Mo % | W ppm | Co ppm | V % | Ti ppm | Nb ppm | Al ppm | N ppm | B ppm | O ppm |
|---|---|---|---|---|---|---|---|---|---|---|---|---|---|---|---|---|---|
| 7P | 0.59 | 0.34 | 0.81 | 80 | 33 | 4.59 | 0.07 | 0.49 | 100 | n.a. | 0.25 | 10 | 20 | 250 | 170 | n.a. | <12 |
| 8P | 0.53 | 0.34 | 0.68 | 190 | 20 | 3.11 | 0.09 | 1.53 | n.a. | n.a. | 0.04 | 20 | <20 | 160 | 80 | n.a. | 9 |
| 9P | 0.55 | 1.02 | 0.74 | 140 | 2 | 2.60 | 0.08 | 2.23 | n.a. | n.a. | 0.83 | <20 | <20 | 410 | 80 | 23 | <12 |
| 10P | 0.51 | 0.22 | 0.44 | 70 | 11 | 5.03 | 0.08 | 2.32 | 20 | 10 | 0.50 | 25 | <10 | 260 | 130 | 1 | 8 |
| 11P | 0.48 | 0.19 | 0.48 | 70 | 6 | 5.00 | n.a. | 2.31 | n.a. | n.a. | 0.50 | n.a. | n.a. | 160 | 160 | n.a. | 10 |
| 12P | 0.46 | 0.18 | 0.48 | 70 | 5 | 4.96 | 0.06 | 2.27 | 30 | 90 | 0.50 | 17 | 10 | 60 | 100 | 1 | 14 |
| 13P | 0.51 | 0.13 | 0.48 | 80 | 3 | 5.02 | 0.06 | 2.34 | 20 | 80 | 0.51 | 16 | 10 | 90 | 110 | 1 | 8 |

n.a. = not analysed

As is shown in Table 9, the hardnesses of the examined steels were equally good, but required, as far as steels 7P and 8P are concerned, low temperature tempering with its known drawbacks. The comparatively good impact toughness of steel 8P, however, in the first place must be attributed to the thinner dimension of the examined flat bar made of that steel. For steel 9P, only a moderately good impact toughness was achieved, although the steel was ESR refined. The measured value of the impact toughness of the round bar of steel 10P, 58 J, was only slightly lower than the measured value of the impact toughness of the round bar of steel 9P, 60 J, in spite of the unfavourable impact direction. It can further be observed, that in the case of equal tests of the impact toughness of the flat bars of the steels 9P and 10P, the clearly best impact toughness, 196 J, could be noted for the steel 10P according to the invention, which shall be compared with 159 J for steel 9P. In this comparison, it should particularly be considered that the 9P steel was ESR refined, which normally improves the toughness. Finally it may be noted that the impact toughness of the steels 11P, 12P, and 13P of the invention, have been strongly improved by the ESR remelting as compared with the non ESR remelted material, steel 10P.

The invention claimed is:

1. Hot worked steel for plastic molding essentially void of primary carbides, having been subjected to austenitizing at 950-1025° C. and hardening and high temperature tempering at 500-570° C., having a hardness of 54-59 HRC and an impact toughness in transverse direction greater than or equal to 80 J, comprising the following chemical composition in weight-%:

0.41-0.60 C;
from traces to 0.5 Si;
from traces to 0.5=(Si+Al);
0.1-2.0 Mn;
3.0-5.5 Cr;
1.5-3.1=(Mo+W/2), however max. 1.0 W and max. 2.6 Mo;
0.30-0.70 V;
max. 0.1 of each of Nb, Ti and Zr;
max. 2.0 Co;
max. 2.0 Ni; and
balance essentially only iron and unavoidable impurities.

2. Steel according to claim 1, containing at least 2.1 Mo.

3. Steel according to claim 1, containing at least 0.44 C.

4. Steel according to claim 3, containing max. 0.55 C.

5. Steel according to claim 1, containing at least 0.40 V.

6. Steel according to claim 5, containing max. 0.65 V.

7. Steel according to claim 1, containing about 0.49 C and about 0.52V.

8. Steel according to claim 1, containing at least 0.05 and max. 0.50 Si.

9. Steel according to claim 8, containing at least 0.1 Si.

10. Steel according to claim 9, containing nominally 0.2 Si.

11. Steel according to claim 1, containing max. 0.50 Al.

12. Steel according to claim 1, containing max. 0.3 W.

13. Steel according to claim 1, containing max. 0.7 Co.

14. Steel according to claim 13, wherein the steel does not contain cobalt exceeding impurity level.

15. Steel according to claim 1, containing max. 1.0 Ni.

16. Steel according to claim 15, containing max. 0.7 Ni.

17. Steel according to claim 16 containing 0.3-0.7 Ni.

18. Steel according to claim 16, wherein the steel does not contain nickel exceeding impurity level.

19. Steel according to claim 1, wherein the content of each of the elements titanium, zirconium and niobium does not exceed 0.03.

20. Steel according to claim 19, wherein the content of each of the elements titanium, zirconium and niobium does not exceed 0.01.

21. Steel according to claim 20, wherein the content of each of the elements titanium, zirconium and niobium does not exceed 0.005.

22. Steel according to claim 1, wherein the steel does not contain more than max. 0.035 P.

23. Steel according to claim 1, wherein the steel contains max. 20 ppm O.

24. Steel according to claim 1, wherein the steel contains max. 300 ppm N.

25. Steel according to claim 1, wherein the steel is ESR remelted.

26. Mold tool manufactured of steel according to claim 1.

27. Steel according to claim 3, containing at least 0.46 C.

28. Steel according to claim 3, containing max. 0.53 C.

29. Steel according to claim 27, containing max. 0.55 C.

30. Steel according to claim 29, containing max. 0.53 C.

31. Steel according to claim 5, containing at least 0.45 V.

32. Steel according to claim 5, containing max. 0.60 V.

33. Steel according to claim 31, containing max. 0.65 V.

34. Steel according to claim 33, containing max. 0.60 V.

35. Steel according to claim 11, containing max. 0.3 Al.

36. Steel according to claim 35, containing max. 0.1 Al.

37. Steel according to claim 36, containing max. 0.03 Al.

38. Steel according to claim 12, containing max. 0.1 W.

39. Steel according to claim 38, wherein the steel does not contain tungsten exceeding impurity level.

40. Steel according to claim 22, wherein the steel does not contain more than max. 0.015 P.

41. Steel according to claim 40, wherein the steel does not contain more than max. 0.010 P.

42. Steel according to claim 23, wherein the steel contains max. 10 ppm O.

43. Steel according to claim 24, wherein the steel contains max. 150 ppm N.

44. Steel according to claim 43, wherein the steel contains max. 100 ppm N.

45. Steel according to claim 1, wherein the steel, after hardening and high temperature tempering at 520-560° C., has a hardness of 56-58 HRC.

46. Mold tool according to claim 26, wherein the steel, after hardening and high temperature tempering at 520-560° C. has a hardness of 56-58 HRC.

47. Steel according to claim 1, wherein the austenitizing temperature is less than 1020° C.

48. Mold tool according to claim 26, wherein the austenitizing temperature is less than 1020° C.

49. Steel according to claim 1, wherein the austenitizing temperature is less than 1000° C.

50. Mold tool according to claim 26, wherein the austenitizing temperature is less than 1000° C.

51. Steel according to claim 1, having an impact toughness in transverse direction greater than 159 J.

52. Steel according to claim 51, having an impact toughness in transverse direction greater than 196 J.

53. Steel according to claim 52, having an impact toughness in transverse direction greater than 216 J.

54. Steel according to claim 53, having an impact toughness in transverse direction greater than 239 J.

55. Steel according to claim 54, having an impact toughness in transverse direction greater than 285 J.

56. Steel according to claim 55, having an impact toughness in transverse direction greater than 336 J.

57. Steel with a material composition, in weight-%, at an austenitizing temperature of 1020° C, comprising:

0.46-0.51 C
0.10-0.25 Si
0.40-0.60 Mn 4.85-5.15 Cr
2.20-2.40 Mo
0.47-0.57 V
0.42-0.46 dissolved C, and
balance essentially only iron and unavoidable impurities,
wherein the MC carbide content is between 0.51-0.59 volume-%, with M referring to an alloying element, and
wherein the steel, having been tempered and cooled to ambient temperature, has a hardness of 54-59 HRC and an impact toughness in transverse direction greater than or equal to 80 J.

58. Steel according to claim 57, wherein the steel comprises:
0.49 C
0.20 Si
0.50 Mn
5.00 Cr
2.30 Mo
0.52 V
0.44 dissolved C, and
0.56 volume-% MC carbides.

59. Steel according to claim 27, containing max. 0.51 C.
60. Steel according to claim 9, containing max. 0.25 Si.
61. Steel according to claim 1, containing 0.40-0.60 Mn.
62. Steel according to claim 1, containing 4.85-5.15 Cr.
63. Steel according to claim 1, containing 2.20-2.40 Mo.
64. Steel according to claim 1, containing 0.47-0.57 V.
65. Steel according to claim 1, containing 0.1-0.3 S.
66. Steel according to claim 1, containing max. 0.03 S.
67. Steel according to claim 66, containing max. 0.01 S.
68. Steel according to claim 67, containing max. 0.003 S.

* * * * *